US006070597A

United States Patent [19]

Motherhead

[11] Patent Number: 6,070,597

[45] **Date of Patent: *Jun. 6, 2000**

[54] SYSTEM FOR PROFESSIONAL ROUND BRUSH BLOW-DRYING

[75] Inventor: Matthew Motherhead, Los Angeles, Calif.

[73] Assignee: M Head, LLC, Beverly Hills, Calif.

[ * ] Notice: This patent is subject to a terminal disclaimer.

[21] Appl. No.: 09/327,920

[22] Filed: Jun. 8, 1999

Related U.S. Application Data

[63] Continuation of application No. 09/232,060, Jan. 15, 1999, Pat. No. 5,954,064.

[51] Int. Cl.[7] ..... A45D 2/24

[52] U.S. Cl. ..... 132/262; 132/150; 16/14 R; 15/145

[58] Field of Search ..... 132/120, 150, 132/226, 237, 242, 265, 262, 118; 15/145, 176.1; 16/114 R

[56] References Cited

U.S. PATENT DOCUMENTS

| | | | |
|---|---|---|---|
| 2,402,470 | 6/1946 | Toro . | |
| 2,452,814 | 11/1948 | Wagle . | |
| 2,595,645 | 5/1952 | Davis et al. . | |
| 2,809,642 | 10/1957 | King . | |
| 3,073,318 | 1/1963 | Catania . | |
| 3,241,561 | 3/1966 | Richmond . | |
| 3,381,693 | 5/1968 | Stevens | 132/237 |
| 3,967,630 | 7/1976 | Zuhlsdorff et al. | 132/262 |
| 3,974,841 | 8/1976 | Weisman . | |
| 4,197,608 | 4/1980 | Holley et al. | 132/118 |
| 5,159,739 | 11/1992 | Adinolfi . | |
| 5,318,052 | 6/1994 | Ivanov . | |
| 5,331,869 | 7/1994 | Webb . | |
| 5,887,600 | 3/1999 | Wilk | 132/150 |

FOREIGN PATENT DOCUMENTS

| | | | |
|---|---|---|---|
| 221272 | 5/1987 | European Pat. Off. | 132/212 |

*Primary Examiner*—Todd E. Manahan
*Attorney, Agent, or Firm*—Blakely,Sokoloff, Taylor & Zafman LLP

[57] ABSTRACT

The present invention relates to a hair styling system having hair styling pieces and a handle. Each hair styling piece has bristles that extend radially outward from an elongated base that fits onto the end of a handle. One hair styling piece and the handle are drawn and held together with magnets and material that is attracted to the magnets. Various embodiments and features are disclosed.

10 Claims, 2 Drawing Sheets

SYSTEM FOR PROFESSIONAL ROUND BRUSH BLOW-DRYING

This is a continuation of application Ser. No. 09/232,060 filed Jan. 15, 1999, now U.S. Pat. No. 5,954,064.

BACKGROUND OF THE INVENTION

1. Field of the Invention

The present invention relates generally to hair devices, and more particularly to hair devices having a handle that is attachable and detachable from one of a plurality of hair styling pieces that both brush and shape hair.

2. Background Information

To style curls into a person's wavy hair, a professional hair stylist convention ally employs round brush blow-drying. In round brush blow-drying, a styling tool such as a round brush is first used to stretch a measure of clean, wet hair so that the hair is straight and taut. Round brushes are known in the industry. For example, Goody Products, Inc. (A Newell Company) of Peachtree, Ga. distributes a round hot curler brush identified as Ace Signature®. With the brush at the end of the hair drawing the hair tight, the stylist applies hot air from a hair dryer to dry the wet hair into smooth, straight, shiny strands. The stylist then either removes the brush and rolls a hair curler into the measure of hair or, preferably, retains the round brush and rolls the hair around the brush. The curler or brush is then clipped to the hair. As a curler or brush resides in the hair, the hot, dry hair rapidly cools and takes shape. The stylist repeats the process until approximately fifteen curlers or brushes reside in the person's hair.

There are problems with the conventional techniques. In the time it takes to go from a brush, to a curler, to a brush, to a curler, etc., the dry hair cools, thus lessening the ability of the curler to hold a tight curl. Under the preferred alternate method, the handles of each brush stick out and interfere with styling the other measures of hair. Moreover, the weight of the handle pulls the curl to one side, out of shape, as the curl cools, as well as causes discomfort to the user.

One solution to the problems with the preferred alternate method is to be able to remove the handle from the brush/styling part after rolling and clipping it to the hair. With this solution, it is also important to be able to retighten the curl by reattaching the handle and rotating the brush/styling part. U.S. Pat. No. 5,318,052 is directed to a hair-curling device in which the handle is releasably connected to a hair-curling element. The only connection/release mechanism taught is two spring loaded pins extending radially towards one another into a cavity of the handle. The handle is then fit around the end of the curler having two mating grooves formed into the end of the curler and is snapped into place. U.S. Pat. No. 5,318,052 cites U.S. Pat. Nos. 3,967,630, 4,004,595, 4,260,871, and 4,712,570 as having a variety of disadvantages which U.S. Pat. No. 5,318,052 seeks to avoid. However, U.S. Pat. No. 5,318,052 has its own disadvantages, especially for users styling their own hair.

With moving parts such as the spring loaded pins taught by U.S. Pat. No. 5,318,052, fine strands of hair may get caught between the pins and the housing of the pins within the handle cavity. These metallic moving parts may degrade over time due to their exposure to the hot, humid hair styling environment. Moreover, with the spring loaded pin/groove solution, it is difficult for users styling their own hair to reattach the handle so as to be able to rotate the curler to retighten the curl. Furthermore, although the long bristles of the hair-curling element taught by U.S. Pat. No. 5,318,052 may avoid the need for auxiliary fixing devices such as a clip, the long bristles of the hair-curling element taught by U.S. Pat. No. 5,318,052 snag and get tangled up in the user's hair, making it difficult to remove such a hair-curling element. And, since the hair-curling elements taught by U.S. Pat. No. 5,318,052 are not capable of brushing and stretching a measure of wet hair straight and taut, the user is required to use a separate styling implement for such a task.

What is needed is a hair styling system where a handle may be releasably attached to one of a variety of styling pieces without moving parts. What is also needed is a styling system where it is relatively easy to reattach the handle to one of the variety of styling pieces, where the bristles of each styling piece are of an appropriate length to prevent snags, and where each styling piece is capable of being used to brush and stretch a measure of wet hair straight and taut as well as used to style a desired curl into the user's hair.

BRIEF SUMMARY OF THE INVENTION

The present invention relates to a hair styling system having hair styling pieces and a handle. Each hair styling piece has bristles that extend radially outward from an elongated base that fits onto the end of a handle. One hair styling piece and the handle are drawn and held together with magnets and material that is attracted to the magnets. Various embodiments and features are disclosed.

DETAILED DESCRIPTION OF THE INVENTION

For purposes of explanation, specific embodiments are set forth to provide a thorough understanding of the present invention. However, it will be understood by one skilled in the art from reading this disclosure that the invention may be practiced without these details. Moreover, well-known elements, devices, process steps and the like are not set forth in detail in order to avoid obscuring the invention.

Figure 1:
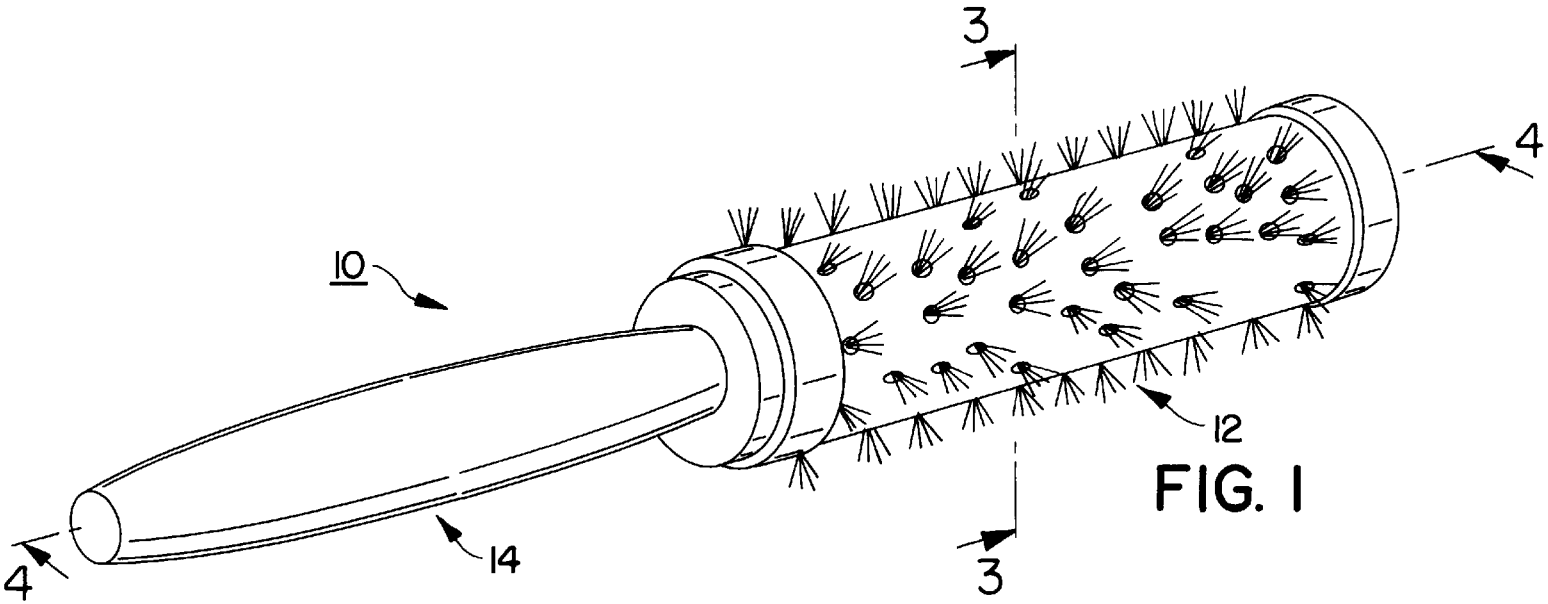
FIG. 1 is an isometric view of a hair styler showing a styling piece assembled into a handle.

Reference is now made to FIGS. 1 through 4 to illustrate the embodiments of the invention. FIG. 1 is an isometric view of hair styler 10 showing styling piece 12 assembled into handle 14. An embodiment of the assembly device may best be seen in FIG. 2.

Figure 2:
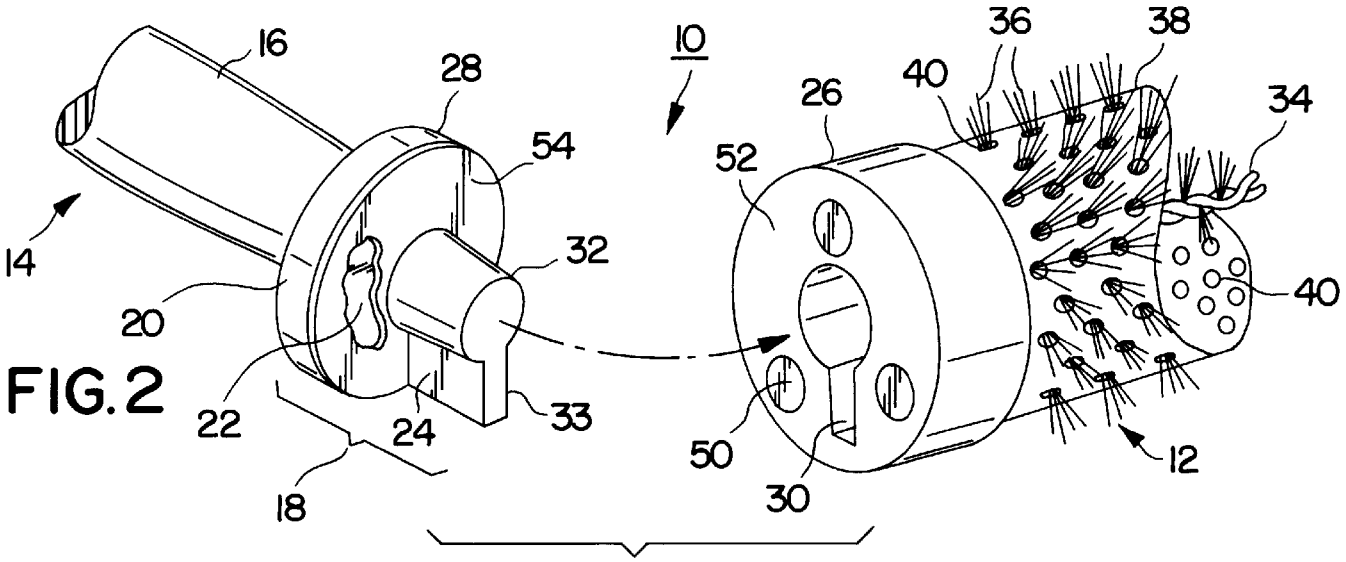
FIG. 2 is an exploded perspective view of the connection between the handle and a styling piece.

FIG. 2 is an exploded perspective view of the connection between handle 14 and styling piece 12. Handle 14 may be made by extending the ergonomically designed handle portion 16 to attachment end 18. Attachment end 18 may have three features: mating pad 20, ring 22, and key 24. Preferably, mating pad 20 has a profile that is similar to the profile of mating end 26 of styling piece 12 and has thickness 28 that preferably permits hiding ring 22 within thickness 28 as well as serves as a rigid surface to limit the travel of key 24 into key hole 30 of styling piece 12 as discussed below. Ring 22 may be made of any metallic or non-metallic material that is attracted to a magnetic field. Ring 22 may be a single continuous piece or several discontinuous pieces disposed within thickness 28.

To maintain a rigid axial alignment between handle 14 and styling piece 12 during use of hair styler 10, key 24 may be provided with cylinder 32. Preferably, cylinder 32 is tapered to make it easier to insert key 24 into key hole 30. To maintain a rigid rotational alignment between handle 14 and styling piece 12 during use of hair styler 10, key 24 may be provided with at least one projection 33 extending radially outward from cylinder 32. Other projections that prevent axial rotation between handle 14 and styling piece 12 may be provided.

To form styling piece 12, two wires 34 may be twisted about bristles 36 so that bristles 36 extend radially away from wires 34, preferably an equal distance so as to form a cylindrical profile. Alternatively, wires 34 may be, for example, elongated plastic into which bristles 36 are molded and secured. The assembly of wires 34 and bristles 36 may then be inserted within cylinder 38. Cylinder 38 is preferably an elongated hollow cylinder having holes 40 that are complementary to three or four bristles 36 and having an outside diameter that is less than the outside diameter of bristles 36. Holes 40 as well as the difference in diameters between cylinder 38 and bristles 36 permits bristles 36 to extend beyond the outside diameter of cylinder 38. This is best seen in FIG. 3.

Figure 3:
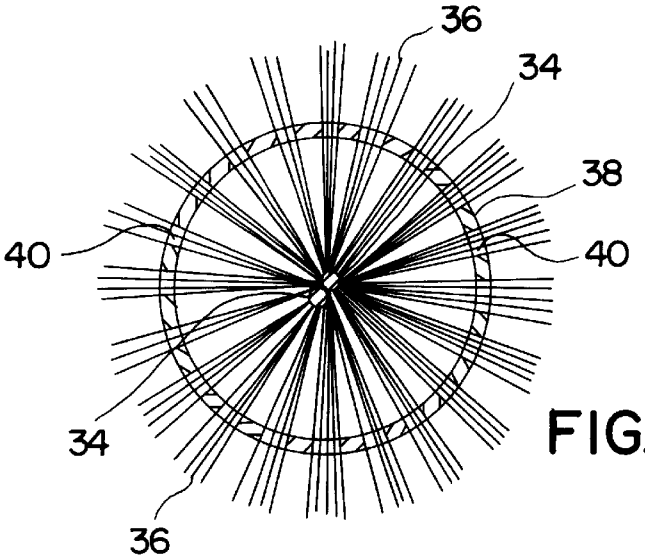
FIG. 3 is a section view of the bristles taken generally off of line 3—3 of FIG. 1.

FIG. 3 is a section view of bristles 36 taken generally off of line 3—3 of FIG. 1. As seen in FIG. 3, bristles 36 extend from wires 34 through holes 40 to an equal distance so as to form a cylindrical profile. This cylindrical profile permits round brush blow-drying. It is important to extend bristles 36 beyond the outside diameter of cylinder 38 to a length that permits brushing a measure of wet hair straight and taut. However, it is also important to limit the length that bristles 36 extend beyond the outside diameter of cylinder 38 to prevent bristles 36 from snagging and getting tangled up in the user's hair when using styling piece 12 to style a curl into the user's hair. Thus, in a preferred embodiment, bristles 36 extend at most one half of an inch beyond the outside diameter of cylinder 38. Preferably, cylinder 38 is made of metal so that cylinder 38 heats up from hot air from a blow dryer to further help dry the user's hair.

Figure 4:
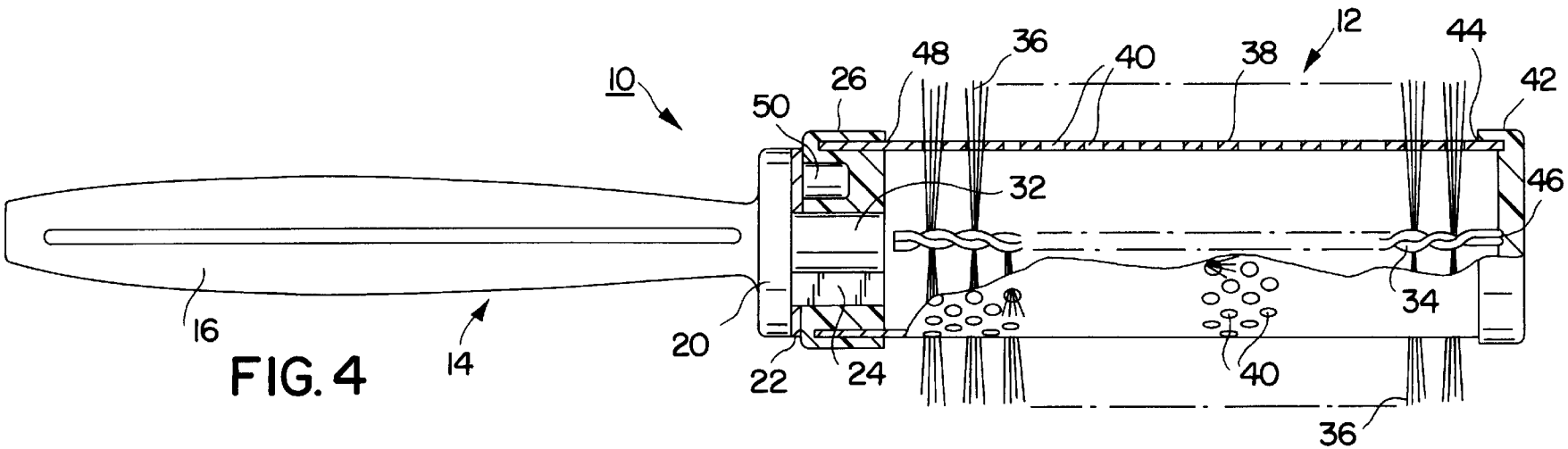
FIG. 4 is a section view of the hair styler taken generally off of line 4—4 of FIG. 1.

To help stabilize the assembly of wires 34 and bristles 36 of FIG. 2 within cylinder 38, it is preferable that wires 34 are supported at one of the two ends of wires 34. FIG. 4 shows this. FIG. 4 is a section view of hair styler 10 taken generally off of line 4—4 of FIG. 1. As seen in FIG. 4, cap 42 may have groove 44 into which one end of cylinder 38 fits. In addition, cap 44 may have mating holes 46 that are in line with the axis of wires 34 and into which wires 34 may be embedded. To further provide stability to the assembly of wires 34 and bristles 36 within cylinder 38, wires 34 may be extended into holes or grooves within mating end 26, although this extra support may not be necessary. Mating end 26 may have groove 48 into which the other end of cylinder 38 fits. The assembly of wires 34, bristles 36, cylinder 38, cap 42, and mating end 26 forms a styling piece 12. Preferably, bristles 36, cap 42, and mating end 26 are made of plastic material.

As discussed above, mating end 26 of styling piece 12 may have key hole 30 as seen in FIG. 2. As shown in FIG. 2, key hole 30 may be formed within the thickness of mating end 26 either through the thickness or partially through the thickness. Preferably, key hole 30 is complimentary to the shape of key 24 of attachment end 18. To contribute to the axial and rotational stability between handle 14 and styling piece 12, the length of key hole 30 permits key 24 to be inserted within key hole 30 until surface 52 of mating end 26 comes into contact with surface 54 of mating pad 20.

FIG. 2 further shows a symmetrical arrangement of three magnets 50 about key hole 30. Magnets 50 may be any material that is surrounded by a magnetic field and may be a single magnet or any number of magnets. Although FIG. 2 shows magnets 50 exposed to surface 52 of mating end 26, preferably magnets 50, similar to ring 22, are hidden within the thickness of mating end 26. This works to protect ring 22 and magnets 50. In an alternate embodiment, magnets 50 may be hidden within thickness 28 of mating pad 20 and ring 22 may be hidden within the thickness of mating end 26.

In operation, handle 14 may be attached, removed, and in particular reattached with ease to one styling piece 12. For example, if a measure of hair is not completely dry after rolling the hair around styling piece 12, it may be necessary to unroll the measure of hair and stretch it out again. To do this, it may be necessary to reattach handle 12 to the styling piece 12 in question. One of the main advantages of using a magnetic attachment system is the ease with which users who are styling their own hair may reattach handle 14 to styling piece 12 residing in the user's own hair. By aligning key 24 within key hole 30, magnets 50 work on ring 22 within handle 14 to draw handle 14 into an attached position as shown by the arrow in FIG. 2. With the magnetic attachment system, the user need only use one hand to reattach handle 14 to a styling piece 12 residing in the user's own hair.

Preferably, the hair styling system is composed of six hair styling pieces 12 and one handle 14, where two of the styling pieces 12 have an outer diameter of two inches, two of the styling pieces 12 have an outer diameter of one and one half inches and the last two styling pieces 12 have an outer diameter of one inch.

While the present invention has been particularly described with reference to the various figures, it should be understood that the figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. A hair styling system, comprising:

a means for coupling having magnetic field material;

at least one hair styling piece having a first end, a second end, a base disposed between the first end and the second end, and a plurality of bristles coupled to the base; and a handle having an attachment end, wherein the second end and the attachment end are coupled to one another through magnetic field material of the means for coupling.

2. The hair styling system of claim 1, the base being an elongated base, the second end having material that is surrounded by a magnetic field, the attachment end having material that is attracted to a magnetic field, wherein the means for coupling includes the material that is surrounded by a magnetic field and the material that is attracted to a magnetic field, and wherein the plurality of bristles extend radially outward from the elongated base.

3. The hair styling system of claim 1, the base being an elongated base, the attachment end of the handle having a magnetic disk and the second end having a disk that is complementary to the magnetic disk, the disk of the second end being attracted to the magnetic disk, wherein the means for coupling includes the magnetic disk and the disk that is complementary to the magnetic disk, and wherein the plurality of bristles extend radially outward from the elongated base.

4. A method for round brush blow-drying hair, comprising:

obtaining a hair styling system comprising a round brush having at least one hair styling piece, the at least one hair styling piece having a first end, a second end, a base disposed between the first end and the second end, and the at least one hair styling piece further having a plurality of bristles coupled to the base, and a handle having an attachment end, wherein the second end and the attachment end are coupled to one another by means of a magnetic field;

stretching a measure of wet hair with the at least one hair styling piece; with the at least one hair styling piece of the round brush drawing the hair tight, applying hot air from a hair dryer to dry the wet hair;

rolling the at least one hair styling piece about the measure of hair; and breaking the magnetic field of the round brush to retain the at least one hair styling piece within the measure of hair and to remove the handle from the at least one hair styling piece.

5. The method of claim 4, wherein the at least one hair styling piece is comprised of six hair styling pieces, where a first and second of the styling pieces have an outer diameter of two inches, a third and fourth of the styling pieces have an outer diameter of one and one half inches, and a fifth and sixth of the styling pieces have an outer diameter of one inch, and wherein obtaining a hair styling system comprising a round brush having at least one hair styling piece includes selecting one of the six hair styling pieces as the at least one hair styling piece.

6. The method of claim 4, wherein stretching a measure of wet hair with the at least one hair styling piece includes stretching a measure of wet hair with the at least one hair styling piece so that the hair is straight and taut, and wherein applying hot air from a hair dryer to dry the wet hair includes drying the wet hair into smooth, straight, shiny strands.

7. The method of claim 4, after rolling the at least one hair styling piece about the measure of hair, the method further comprising:

clipping the at least one hair styling piece to the measure of hair with a clip.

8. The method of claim 7, after breaking the magnetic field of the round brush, the method further comprising:

engaging the magnetic field of the round brush to reattach the handle to the at least one hair styling piece;

removing the clip from the at least one hair styling piece; and unrolling the at least one hair styling piece from about the measure of hair.

9. The method of claim 7, after breaking the magnetic field of the round brush, the method further comprising:

engaging the magnetic field of the round brush to reattach the handle to the at least one hair styling piece;

removing the clip from the at least one hair styling piece;

unrolling the at least one hair styling piece from about the measure of hair;

applying hot air from a hair dryer to the measure of hair;

retightening the measure of hair by rolling the at least one hair styling piece about the measure of hair; and breaking the magnetic field of the round brush to retain the at least one hair styling piece within the measure of hair and to remove the handle from the at least one hair styling piece.

10. The method of claim 9, after retightening the measure of hair and breaking the magnetic field of the round brush, the method further comprising:

engaging the magnetic field of the round brush to reattach the handle to the at least one hair styling piece;

removing the clip from the at least one hair styling piece; and unrolling the at least one hair styling piece from about the measure of hair.

* * * * *